US010179713B2

(12) United States Patent
Kuno et al.

(10) Patent No.: US 10,179,713 B2
(45) Date of Patent: Jan. 15, 2019

(54) SHEET FEEDING DEVICE, FEEDING TRAY, AND IMAGE FORMING APPARATUS

(71) Applicants: Satoshi Kuno, Tokyo (JP); Yosuke Eguchi, Tokyo (JP)

(72) Inventors: Satoshi Kuno, Tokyo (JP); Yosuke Eguchi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/803,314

(22) Filed: Nov. 3, 2017

(65) Prior Publication Data

US 2018/0127222 A1 May 10, 2018

(30) Foreign Application Priority Data

Nov. 8, 2016 (JP) ..... 2016-217775

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2402/515* (2013.01); *B65H 2403/53* (2013.01); *B65H 2405/112* (2013.01); *B65H 2405/115* (2013.01); *B65H 2405/1132* (2013.01); *B65H 2405/121* (2013.01); *B65H 2405/31* (2013.01); *G03G 2215/00358* (2013.01)

(58) Field of Classification Search
CPC ..... B65H 1/266; B65H 1/04; B65H 2405/31; B65H 2405/1132; B65H 2405/121; B65H 2405/115; B65H 2405/515
See application file for complete search history.

(56) References Cited

U.S. PATENT DOCUMENTS 7,731,180 B2 * 6/2010 Ohnishi ..... B65H 1/266 271/145
8,061,707 B2 * 11/2011 Sugishima ..... B65H 1/266 271/145
8,205,875 B2 * 6/2012 Kusumi ..... B65H 5/38 271/162

(Continued)

FOREIGN PATENT DOCUMENTS

JP 2004-075293 3/2004
JP 2009-120399 6/2009
JP 2015-093746 5/2015

*Primary Examiner* — Patrick Cicchino
(74) *Attorney, Agent, or Firm* — Duft & Bornsen, PC

(57) ABSTRACT

A sheet feeding device includes a device body including a stopper portion and a feeding tray detachably mounted to the device body. The feeding tray includes a stopper, a lock assembly, and an operating member. The stopper includes a stopped portion movable between a stop position at which the stopped portion is stopped by the stopper portion and a release position. The lock assembly prevents drawing of the feeding tray from the device body. An operating member rotates from an initial state by a predetermined angle to move the stopped portion from the stop position to the release position. The lock assembly restricts rotation of the operating member when the lock assembly is locked. The stopped portion is movable from the stop position to the release position with an operation of mounting the feeding tray to a mount position of the device body without rotation of the operating member.

18 Claims, 4 Drawing Sheets

(56) References Cited

U.S. PATENT DOCUMENTS

| | | | | |
|---|---|---|---|---|
| 8,870,178 | B2 * | 10/2014 | Taoka | B65H 1/00 271/145 |
| 9,102,489 | B2 * | 8/2015 | Uohashi | B65H 1/266 |
| 9,718,631 | B2 * | 8/2017 | Eguchi | B65H 1/04 |
| 2010/0059928 | A1 * | 3/2010 | Sugishima | B65H 1/266 271/109 |
| 2015/0132039 | A1 | 5/2015 | Tobinaga et al. | |
| 2015/0253715 | A1 | 9/2015 | Tobinaga et al. | |
| 2016/0001994 | A1 * | 1/2016 | Kuwata | B65H 1/266 271/153 |
| 2016/0145061 | A1 * | 5/2016 | Maruta | B65H 1/266 271/171 |
| 2016/0332829 | A1 * | 11/2016 | Eguchi | B65H 1/04 |
| 2017/0308029 | A1 * | 10/2017 | Soda | B65H 1/266 |

* cited by examiner

SHEET FEEDING DEVICE, FEEDING TRAY, AND IMAGE FORMING APPARATUS

CROSS-REFERENCE TO RELATED APPLICATION

This patent application is based on and claims priority pursuant to 35 U.S.C. § 119(a) to Japanese Patent Application No. 2016-217775, filed on Nov. 8, 2016 in the Japan Patent Office, the entire disclosure of which is hereby incorporated by reference herein.

BACKGROUND

Technical Field

Aspects of the present disclosure relate to a sheet feeding device to feed a sheet, such as a sheet of paper, a feeding tray to stack sheets to be fed, and an image forming apparatus including the sheet feeding device.

Related Art

An apparatus, such as an image forming apparatus, to perform processing, such as image forming processing, on a sheet, such as a sheet of paper, may include a sheet feeding device as described below. The sheet feeding device includes, for example, a device body and a feeding tray that includes a stopper and a lock assembly. The stopper includes a stopper portion to be stopped by a stopper portion of the device body and is movable between a stop position at which the stopped portion is stopped by the stopper portion and a release position at which the stopped portion is released from the stopper portion. The lock assembly prevents the feeding tray from being drawn from the device body.

SUMMARY

In an aspect of the present disclosure, there is provided a sheet feeding device that includes a device body including a stopper portion and a feeding tray detachably mounted to the device body. The feeding tray includes a stopper, a lock assembly, and an operating member. The stopper includes a stopped portion to be stopped by the stopper portion. The stopper is movable between a stop position at which the stopped portion is stopped by the stopper portion and a release position at which the stopped portion is released from the stopper portion. The lock assembly prevents drawing of the feeding tray from the device body. An operating member rotates from an initial state by a predetermined angle to move the stopped portion from the stop position to the release position. The lock assembly restricts rotation of the operating member when the lock assembly is locked. The stopped portion of the stopper is movable from the stop position to the release position with an operation of mounting the feeding tray, which is drawn from the device body, to a mount position of the device body without rotation of the operating member.

In another aspect of the present disclosure, there is provided an image forming apparatus that includes an image forming unit to form an image on a sheet and the sheet feeding device to feed the sheet to the image forming unit.

In still another aspect of the present disclosure, there is provided a feeding tray detachably mountable to a device body of a sheet feeding device. The feeding tray includes a stopper, a lock assembly, and an operating member. The stopper includes a stopped portion to be stopped by a stopper portion of the device body. The stopper is movable between a stop position at which the stopped portion is stopped by the stopper portion and a release position at which the stopped portion is released from the stopper portion. The lock assembly prevents drawing of the feeding tray from the device body. The operating member rotates from an initial state by a predetermined angle to move the stopped portion from the stop position to the release position. The lock assembly restricts rotation of the operating member when the lock assembly is locked. The stopped portion of the stopper is movable from the stop position to the release position with an operation of mounting the feeding tray, which is drawn from the device body, to a mount position of the device body without rotation of the operating member.

In still another aspect of the present disclosure, there is provided an image forming apparatus that includes an image forming unit to form an image on a sheet and the feeding tray to stack the sheet to be fed to the image forming unit.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
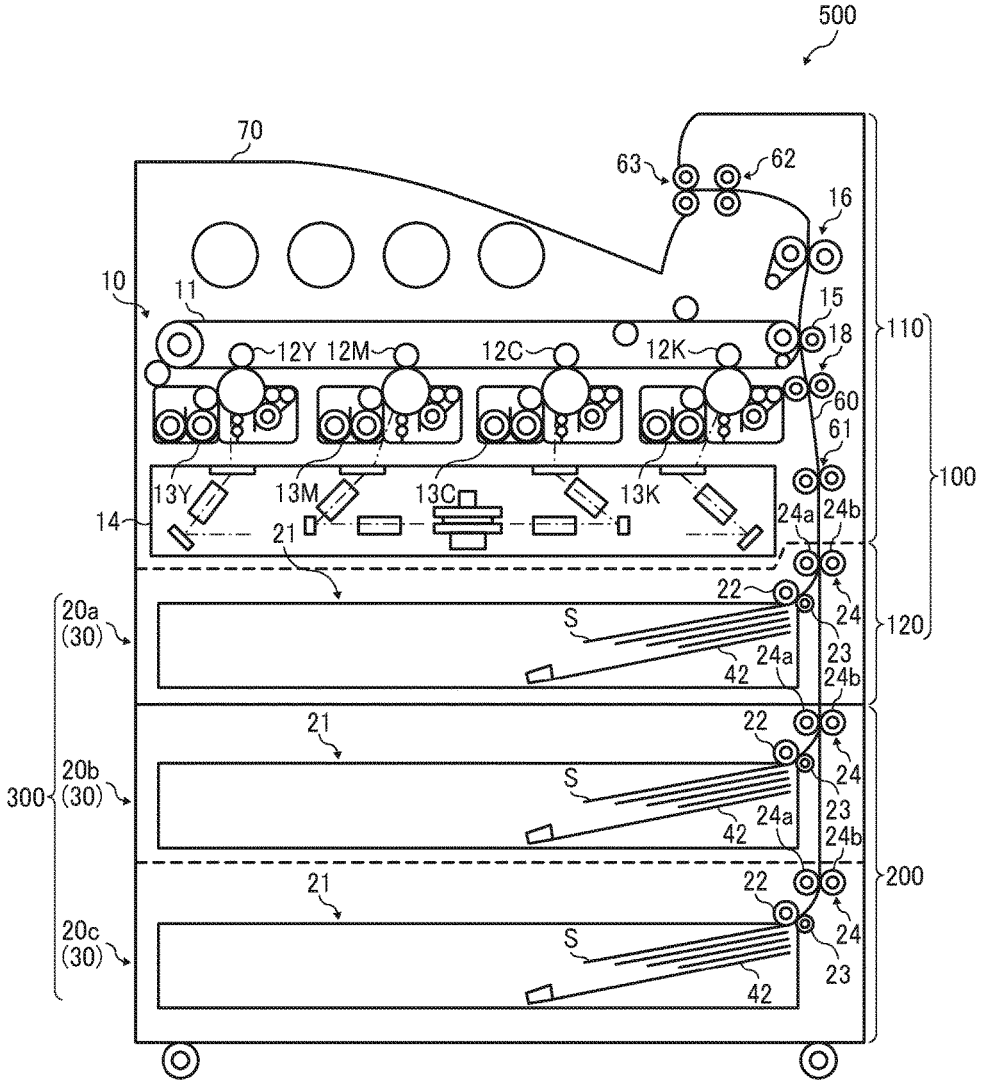
FIG. 1 is a schematic view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Below, an image forming apparatus 500 according to an embodiment of the present disclosure is described with an example of an electrophotographic color printer that forms a color image on a sheet (hereinafter referred to as "sheet S" as appropriate) which is a recording material. Here, examples of the term "sheet" include a sheet of paper, a coated sheet of paper, a label sheet of paper, an overhead projector (OHP) sheet, and a film. First, a schematic configuration of the image forming apparatus 500 is described with reference to FIG. 1. FIG. 1 is a schematic view of the image forming apparatus 500 according to the present embodiment.

As illustrated in FIG. 1, the image forming apparatus 500 includes an image forming unit 110 and a first sheet feeding device 20*a* as a body sheet feeding unit 120 in an apparatus body 100. The image forming apparatus 500 includes an additional sheet feeding section 200 additionally installed below the apparatus body 100. Therefore, a sheet feeding section 300 of the image forming apparatus 500 includes three-stage sheet feeding devices 20, that is, the first sheet feeding device 20*a* in the apparatus body 100 and a second sheet feeding device 20*b* and a third sheet feeding device 20*c* in the additional sheet feeding section 200. Hereinafter, the sheet feeding devices 20*a*, 20*b*, and 20*c* may be collectively referred to as sheet feeding devices 20.

An intermediate transfer device 10 is disposed inside the apparatus body 100. In the intermediate transfer device 10, an intermediate transfer belt 11 that is an endless belt looped around a plurality of rollers is stretched substantially horizontally so as to travel counterclockwise in FIG. 1. Below the intermediate transfer device 10, image forming devices 13Y, 13M, 13C, and 13K for yellow (Y), magenta (M), cyan (C), and black (K) are arranged in a quadruple tandem manner along an extended direction of the intermediate transfer belt 11.

Each of the image forming devices 13Y, 13M, 13C, and 13K (collectively referred to as image forming devices 13) as image forming units includes a drum-shaped photoconductor rotatable in a clockwise direction in FIG. 1. Each of the image forming devices 13 includes, e.g., a charging device, a developing device, a transfer device, and a photoconductor cleaning device around the photoconductor. An exposure device 14 is disposed below the image forming devices 13. A plurality of feeding trays 21 to stack and store sheets S are disposed below the exposure device 14. The image forming apparatus 500 includes the first sheet feeding device 20*a*, the second sheet feeding device 20*b*, and the third sheet feeding device 20*c* as the sheet feeding devices to feed the sheet S to a secondary transfer portion of the intermediate transfer device 10.

Each of the first sheet feeding device 20*a*, the second sheet feeding device 20*b*, and the third sheet feeding device 20*c* includes a sheet feeding roller 22, a separating roller 23, and paired vertical conveying rollers 24 in an upper right part of the feeding tray 21 in FIG. 1. The sheet feeding roller 22 feeds an uppermost sheet S of the sheets S to a sheet conveyance path 60. The separating roller 23 separates the sheets S sheet by sheet. The paired vertical conveying rollers 24 vertically feeds the sheet S fed by the sheet feeding roller 22. The sheet feeding roller 22 and a conveyance driving roller 24*a*, which is a driving roller of the paired vertical conveying rollers 24, are arranged on a device body side of each sheet feeding device 20. The separating roller 23 and a conveyance driven roller 24*b*, which is a driven roller of the paired vertical conveying rollers 24, are disposed on the feeding tray 21 side of each sheet feeding device 20.

A sheet conveyance path 60 is a vertical conveyance path formed from a lower area to an upper area of the right side of the apparatus body 100 illustrated in FIG. 1 and leads to a sheet stack 70 disposed at an upper portion of the image forming apparatus 500. In addition to the paired vertical conveying rollers 24 including the conveyance driving roller 24*a* and the conveyance driven roller 24*b* of each sheet feeding device 20, the following components are disposed along the sheet conveyance path 60. Examples of the components includes paired pre-registration conveying rollers 61, paired registration rollers 18, a secondary transfer device 15, a fixing device 16, paired post-fixing conveying rollers 62, and paired ejection rollers 63. The paired pre-registration conveying rollers 61 convey the sheet S, which is conveyed from each sheet feeding device 20, toward the paired registration rollers 18. The secondary transfer device 15 is disposed opposite the intermediate transfer belt 11. The paired post-fixing conveying rollers 62 convey the sheet S, which having passed through the fixing device 16, toward the paired ejection rollers 63. The paired ejection rollers 63 eject the conveyed sheet S to the sheet stack 70.

When printing data is received from an external device, such as a personal computer to perform printing (image formation), the exposure device 14 writes electrostatic latent images on the photoconductors of the image forming devices 13. The developing devices of the image forming devices 13 develop the electrostatic latent images to form toner images of the respective colors on the photoconductors of the image forming devices 13. Primary transfer devices 12Y, 12M, 12C, and 12K primarily transfer the toner images of the respective colors, which have been formed with the image forming devices 13, on the intermediate transfer belt 11 in turn to form a composite color toner image on the intermediate transfer belt 11.

In parallel with the above-described image forming operation, the sheet feeding roller 22 of one of the sheet feeding devices 20 is selectively rotated to feed the sheet S from the corresponding feeding tray 21 to the sheet conveyance path 60. In addition, when there is another sheet feeding device 20 above the one of the sheet feeding devices 20, the corresponding paired vertical conveying rollers 24 are also driven. The paired pre-registration conveying rollers 61 and the paired registration rollers 18 are driven to convey the sheet S to a secondary transfer position in the secondary transfer device 15 in synchronous with the composite color toner image conveyed to the secondary transfer position. The composite color toner image formed on the intermediate transfer belt 11 is secondarily transferred onto the sheet S with the secondary transfer device 15. After the secondary transfer, the fixing device 16 fixes the composite color toner image on the sheet S and the paired post-fixing conveying rollers 62 convey the sheet S. The conveyed sheet S is ejected by the paired ejection rollers 63 and stacked on the sheet stack 70. Here, in each image forming device 13, non-transferred residual toner and other substances remaining on the photoconductor after the primary transfer is scraped off and cleaned by the photoconductor cleaning device. In the intermediate transfer device 10, non-transferred residual toner and other substances remaining on the intermediate transfer belt 11 after the secondary transfer is scraped off and cleaned by a belt cleaning device.

Figure 2:
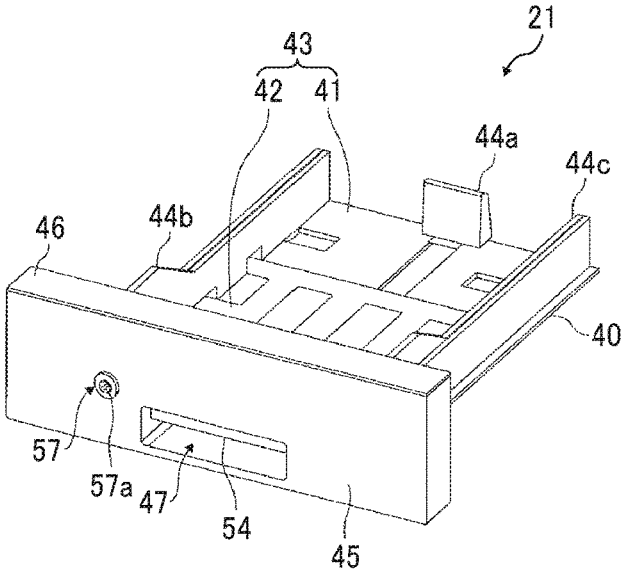
FIG. 2 is a perspective view of a feeding tray.

Next, the feeding tray 21 included in each sheet feeding device 20 is described with reference to FIG. 2. FIG. 2 is a perspective view of the feeding tray 21 in the present embodiment. Here, the configuration of a sheet-feeding-device body 30 of each of the sheet feeding devices 20*a*, 20*b*, and 20*c* is different only in whether the device body 30 is disposed inside the apparatus body 100 or disposed as the additional sheet feeding section 200, and the sheet-feeding-device body 30 of the sheet feeding devices 20*a*, 20*b*, and 20*c* have the same basic internal structure. The same feeding tray 21 can be used as a sheet feeding tray to be mounted on the device body 30 of each of the sheet feeding devices 20*a*, 20*b*, and 20*c*. Therefore, in the following description, the sheet feeding devices 20*a*, 20*b*, and 20*c* are described as "sheet feeding device 20" unless particularly distinguished.

As illustrated in FIG. 2, the feeding tray 21 mounted (accommodated) in the sheet-feeding-device body 30 of the sheet feeding device 20 includes a feeding-tray bottom plate 41 at the bottom of a feeding-tray housing 40. A front-cover housing 48 (see FIG. 3) is connected to a downstream side of the feeding-tray bottom plate 41 in a direction (hereinafter, drawing direction) of the feeding tray 21 in which the feeding tray 21 is drawn from the sheet-feeding-device body 30. A front cover 45 is mounted to the front-cover housing 48. A pressure plate 42 is disposed in a predetermined range from substantially the center of the feeding-tray bottom plate 41 in the drawing direction to the vicinity of the inner side of the front-cover housing 48. The pressure plate 42 is swingable to press the uppermost sheet S of the sheets S, which are loaded on the feeding tray 21, toward the sheet feeding roller 22. Upper surfaces of the swingable pressure plate 42 and the feeding-tray bottom plate 41 act as a sheet stack portion 43 of the feeding tray 21 to stack the sheets S.

A left-side fence 44*b* and a right-side fence 44*c* are disposed at both ends of the feeding-tray bottom plate 41 in a lateral direction perpendicular to the drawing direction, to regulate the positions of both ends of a bundle of sheets S, which are stacked on the feeding-tray bottom plate 41, in the lateral direction. The position of each of the left-side fence 44*b* and the right-side fence 44*c* is adjustable according to the width of the sheet S in the lateral direction. An end fence 44*a* is disposed on a downstream side (rear side) of the swingable pressure plate 42 in the drawing direction. The end fence 44*a* regulates the position of a downstream end of the bundle of sheets S, which are stacked on the feeding-tray bottom plate 41, in the drawing direction. The position of the end fence 44*a* is adjustable according to the length of the sheet S in the drawing direction.

A cylinder lock 57 of a lock assembly 56, which is further described later, is mounted to the front cover 45 to prevent the feeding tray 21 from being drawn from the sheet-feeding-device body 30 of the sheet feeding device 20. The front cover 45 includes a front-cover recess 47 and a handle 54 disposed inside the front-cover recess 47. Operating the handle 54 can release the locking (holding) of the feeding tray 21 in the drawing direction (hereinafter may be referred to as unlocking). An upper cover 46 is disposed on an upper portion of the front cover 45 to prevent a user from touching the inside of the front cover 45.

In the example of the sheet feeding device 20 disposed in the image forming apparatus 500 according to the present embodiment, the feeding tray 21 is drawn from the sheet-feeding-device body 30 to the right side in FIG. 1 at which the sheet conveyance path 60 to vertically convey the sheet S is disposed. When the removed feeding tray 21 is installed, the feeding tray 21 is slid and pushed to the left side in FIG. 1 and mounted to a mount position of the sheet-feeding-device body 30.

Figure 3:
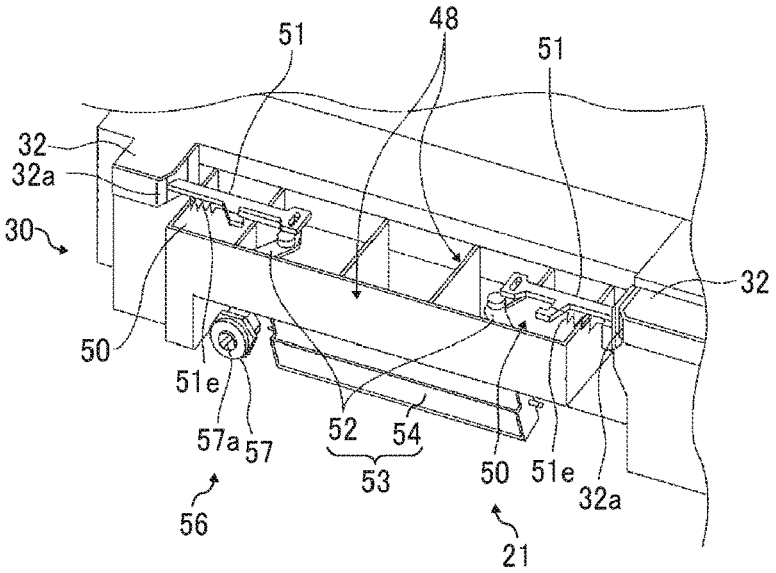
FIG. 3 is an illustration of the interior of a front cover.

Next, outlines of the internal configuration and operation of the front cover 45 of the feeding tray 21 are described with reference to FIG. 3. FIG. 3 is an illustration of the inside of the front cover 45 and is an enlarged view of the inside of the front cover 45 in which the front cover 45 and the upper cover 46 illustrated in FIG. 2 are not illustrated.

The front-cover housing 48 of the feeding tray 21 is provided with, for example, the following components. Examples of the components includes components of a lock unit 50, such as a lock member 51, to lock the position of the feeding tray 21, which is mounted to the mount position of the sheet-feeding-device body 30, by engaging with (fitting to) a stopper portion 32 of the sheet-feeding-device body 30. Examples of the components also include components of a release assembly 53, such as the handle 54, to perform the unlocking of moving a stopped portion 51*a* of the lock member 51 (see, e.g., FIG. 4) from a stop position, at which the stopped portion 51*a* is stopped by the stopper portion 32, to a release position, at which the stopped portion 51*a* is released from the stopper portion 32, by rotating the handle 54 from an initial state by a predetermined angle by a user. Examples of the components further include components of the lock assembly 56, such as the cylinder lock 57, to prevent the feeding tray 21 from being drawn from the sheet-feeding-device body 30.

Two lock units 50 are disposed at both sides of the front-cover housing 48 in the lateral direction so that the stopped portion 51*a* (see FIG. 4) of the lock member 51 of each lock unit 50 is stopped by the stopper portion 32 at each lateral side of an inner surface of the sheet-feeding-device body 30. Each lock unit 50 includes, e.g., the lock member 51 and a tension spring 51*e*. The lock member 51 is slidable in the lateral direction by a predetermined amount relative to the front-cover housing 48. The tension spring 51*e* urges the lock member 51 in a direction in which the stopped portion 51*a* is stopped by the stopper portion 32. The release assembly 53 includes, e.g., the handle 54 and two link members 52. The handle 54 rotates so that, when a lower portion of the handle 54 is drawn in the drawing direction, an upper part of the handle 54 moves to a direction opposite the drawing direction. The link members 52 transmit the movement of the upper portion of handle 54 to the lock units 50, which are disposed at both sides of the handle 54 in the drawing direction. The lock assembly 56 includes, e.g., the cylinder lock 57 and a hook 58 (see FIG. 4). The cylinder lock 57 is disposed so that a key hole 57*a* is located on a downstream side (front side) in the drawing direction. The hook 58 is mounted on a rotatable cylinder 57*b* of the cylinder lock 57.

The lock member 51 and the link member 52 on each of the left and right sides of the front-cover housing 48 are mounted on an upper portion of the front-cover housing 48. Mounting the upper cover 46 illustrated in FIG. 2 prevents the lock member 51 and the link members 52 from detaching upward. The handle 54 is disposed at substantially the center of the front-cover housing 48 in the lateral direction and can be operated by fingers of a user inserted from the front-cover recess 47 illustrated in FIG. 2. The handle 54 has a height hidden in the front-cover recess 47. The cylinder lock 57 is disposed in the vicinity of the left side of a lower portion of the handle 54 in FIG. 2.

When the feeding tray 21 is mounted to the mount position of the sheet-feeding-device body 30 and the handle 54 of the release assembly 53 is in the initial state, the lock member 51 of each lock unit 50 engages with the stopper portion 32 of the sheet-feeding-device body 30 by the tensile force of the tension spring 51*e*. Accordingly, the position of the feeding tray 21, which is mounted to the mount position of the sheet-feeding-device body 30, with respect to the sheet-feeding-device body 30 is stopped (locked), and the sliding of the feeding tray 21 is locked.

The front-cover housing 48 and the lock member 51 are connected by the tension spring 51*e*, and a force (urging force) is applied to the lock member 51 in a direction in which the lock member 51 engages with the stopper portion 32. When the user draws the handle 54 of the feeding tray 21, the link members 52 on the left and right sides of the handle 54 are pushed and rotated by the upper portion of the handle 54, thus causing each of the lock members 51 of the lock units 50 to move inward. As a result, the stopped portion 51*a* of the lock member 51 is moved from the stop position, at which the stopped portion 51*a* is stopped by the stopper portion 32 disposed at the sheet-feeding-device body 30, to the release position. Thus, the locking of the stopped portion 51*a* with the stopper portion 32 is released, thus allowing the feeding tray 21 to be drawn from the sheet-feeding-device body 30.

Figure 4:
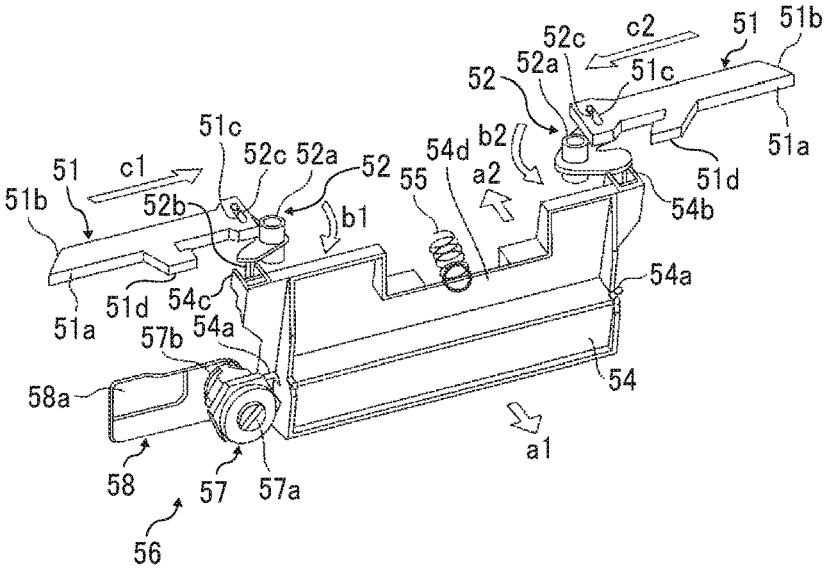
FIG. 4 is an illustration of configurations of a lock unit, a release assembly, and a lock assembly of the feeding tray and unlocking operation.

Next, more detailed configurations and unlocking operation of the lock unit 50, the release assembly 53, and the lock assembly 56 of the feeding tray 21 are described with reference to FIG. 4. FIG. 4 is an illustration of more detailed configurations and unlocking operation of the lock unit 50, the release assembly 53, and the lock assembly 56 of the feeding tray 21. Note that the front-cover housing 48 and the feeding-tray housing 40 are not illustrated in FIG. 4.

The lock member 51 of each lock unit 50 is a member extending long in the lateral direction in which the lock member 51 slides. In an extending portion of the lock member 51 toward the stopper portion 32 of the sheet-feeding-device body 30, the stopped portion 51*a* is disposed on the downstream side in the drawing direction and a lock-member tapered portion 51*b* is disposed on the upstream side in the drawing direction. On the other hand, a link engagement hole 51*c*, which is a long round hole extending long in the drawing direction, is disposed near an inner end portion of the lock member 51 remote from the stopper portion 32 of the sheet-feeding-device body 30. A spring hook portion 51*d* to hook the tension spring 51*e* on is disposed in a substantially central portion of the lock member 51 in the longitudinal direction of the lock member 51. The tension spring 51*e* urges the lock member 51 (the stopped portion 51*a*) toward the stopper portion 32. The tension spring 51*e* of each lock unit 50 is hooked on a spring hook portion of the front-cover housing 48 on the side closer to the stopper portion 32 and on the spring hook portion 51*d* of the lock member 51 on the opposite side (inner side). The lock member 51 of each lock unit 50 is slidably held in the lateral direction by the front-cover housing 48 and urged toward the stopper portion 32 of the sheet-feeding-device body 30 by the tension force of the tension spring 51*e*.

The lower portion of the handle 54 of the release assembly 53 is a portion on which a user hooks a finger to pull when the user releases the lock. Link engagement recesses 54*b* are disposed on the left and right sides of the upper portion of the handle 54. A compression spring stopper 54*d* is provided at substantially the center of the upper portion of the handle 54 in the lateral direction. Rotary projections 54*a* as fulcrums for rotating the handle 54 are disposed at a boundary between the upper portion and the lower portion of each of left and right side faces of the handle 54. The left and right rotary projections 54*a* engage with engagement portions of the front-cover housing 48 to form a rotation shaft of the handle 54.

Each of the link engagement recesses 54*b* includes a bottom portion and two side plates. The bottom portion pushes and rotates handle engagement projections 52*b* of the link members 52 when the handle 54 is rotated. The side plates guide the handle engagement projections 52*b*. In FIG. 4, ends of the two side plates of one of the link engagement recesses 54*b* at the left side in FIG. 4 constitute a hook contact portion 54*c*. The hook contact portion 54*c* contacts the hook 58 (handle contact portion 58*a*) of the locked lock assembly 56, so that the rotation of the handle 54 is restricted. A compression spring 55 is disposed between the compression spring stopper 54*d* and the front-cover housing 48 disposed on the upstream side of the handle 54 in the drawing direction. One end of the compression spring 55 is attached to the compression spring stopper 54*d*, thus urging the handle 54 toward the initial position by a pressing force of the compression spring 55.

The link members 52 of the release assembly 53 are attached to be bilaterally symmetrical with each other. The link members 52 are substantially parallel to the sliding direction (drawing direction) of the feeding tray 21. The following shaped parts are provided on a plate portion of a substantially L-shape having roundly-chamfered corners. An upper surface of the plate portion is provided with an upper portion of a link rotation shaft 52*a*, which is fitted to a fitting portion of the upper cover 46 and acts as a rotation shaft of the link member 52, and a columnar lock-member engagement projection 52*c* to be inserted into the link engagement hole 51*c* of the lock member 51 rotation shaft inserted into the link engagement hole 51*c* of the lock member 51. A bottom of the plate portion is provided with the handle engagement projection 52*b* and a lower portion of the link rotation shaft 52*a*. The handle engagement projections 52*b* fit in the link engagement recesses 54*b* of the handle 54. When the handle 54 is rotated, the handle engagement projection 52*b* contacts and is pushed by the bottom portion of the link engagement recess 54*b*. The lower portion of the link rotation shaft 52*a* is fitted to the front-cover housing 48. Each link member 52 is rotated in conjunction with the rotation of the handle 54 with a certain amount of rotation or greater or the sliding motion of the lock member 51. With such a configuration, when the user pulls the lower portion of the handle 54 and rotates the handle 54 by a certain amount of rotation or greater, each link member 52 rotates around the axis of the link rotation shaft 52*a*. Thus, the rotation of the handle 54 is converted into the sliding motion of each lock member 51 for transmission.

The lock assembly 56 includes, e.g., the cylinder lock 57, the hook 58, and a portion of the front-cover housing 48 to hold the cylinder lock 57. The cylinder lock 57 is disposed so that the key hole 57*a* is located on a downstream side (front side) in the drawing direction. The hook 58 is mounted on a rotatable cylinder 57*b* of the cylinder lock 57. When the cylinder lock 57 is unlocked, the hook 58 is in a substantially horizontal rotational position as illustrated in FIG. 4. When the key inserted in the key hole 57*a* is rotated by, for example, 90° in a clockwise direction, the hook 58 mounted on the cylinder 57*b* rotates clockwise by 90° (see FIG. 5). The hook 58 includes the handle contact portion 58*a*. When the hook 58 is locked by rotating the hook 58 clockwise by 90°, the handle contact portion 58*a* is put in a rotation space of the handle 54 (a rotation space of the hook contact portion 54*c*) to restrict the amount of rotation of the handle 54. When the handle 54 is rotated in the locked state, the handle contact portion 58*a* contact the hook contact portion 54*c* to restrict the amount of rotation of the handle 54. The hook contact portion 54*c* includes end portions of the two side plates of the handle engagement projection 52*b* disposed on the left side of the handle 54.

The lock unit 50, the release assembly 53, and the lock assembly 56 of the feeding tray 21 have the above-described configurations. When a user draws (the lower portion of) the handle 54 to release the lock in a state in which the lock assembly 56 is unlocked, the release assembly 53 and the lock unit 50 operate as follows. In the release assembly 53, when the lower portion of the handle 54 is pulled in a direction indicated by arrow a1 in FIG. 4, the handle 54 rotates around the two the rotary projections 54*a*. The upper portion of the handle 54 moves in a direction indicated by arrow a2 in FIG. 4 toward the back side of the feeding tray 21 and engage with the two right and left link members 52. In FIG. 4, the left link member 52 rotate in a direction indicated by arrow b1 and the right link member 52 rotates in a direction indicated by arrow b2. In the lock unit 50, as the link members 52 rotate, the two right and left lock members 51 fitted to the respective link members 52 slide inward (in directions indicated by arrows c1 and c2). Each of the stopped portions 51*a* of the lock members 51 moves from the stop position to the release position, and the lock of the feeding tray 21 is released. Here, in a state in which the lock assembly 56 is unlocked, as described above, the hook 58 attached to the cylinder 57*b* of the cylinder lock 57 is in the substantially horizontal rotational position as illustrated in FIG. 4.

Figure 5:
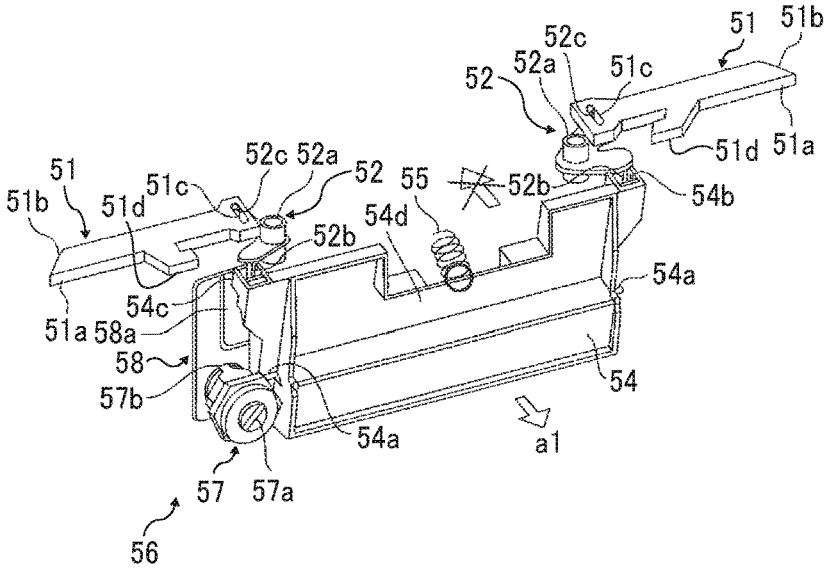
FIG. 5 is an illustration of a state in which the feeding tray is locked.

Next, a state in which the feeding tray 21 is locked is described with reference to FIG. 5. FIG. 5 is an illustration of a state in which the feeding tray 21 is locked. Note that, in FIG. 4, the front-cover housing 48 and the feeding-tray housing 40 in FIG. 3 are not illustrated similarly with FIG. 4.

In a state where the feeding tray 21 is locked, that is, when the lock assembly 56 is locked, (the handle contact portion 58*a* of) the hook 58 attached to the cylinder 57*b* of the cylinder lock 57 rotates 90° and is put in the movable space of the handle 54. When the handle 54 is pulled to draw the feeding tray 21 in such a state, the hook contact portion 54*c*, which is disposed at the upper left portion of the handle 54, contacts the handle contact portion 58*a* of the hook 58, thus preventing the handle 54 from being pulled. Accordingly, the link members 52 and the lock members 51 on the left and right sides do not operate, and the stopped portion 51*a* on each lock member 51 does not move from the stop position to the release position. Thus, the feeding tray 21 is locked, thus preventing the feeding tray 21 from being drawn from the sheet-feeding-device body 30.

Figure 6A:
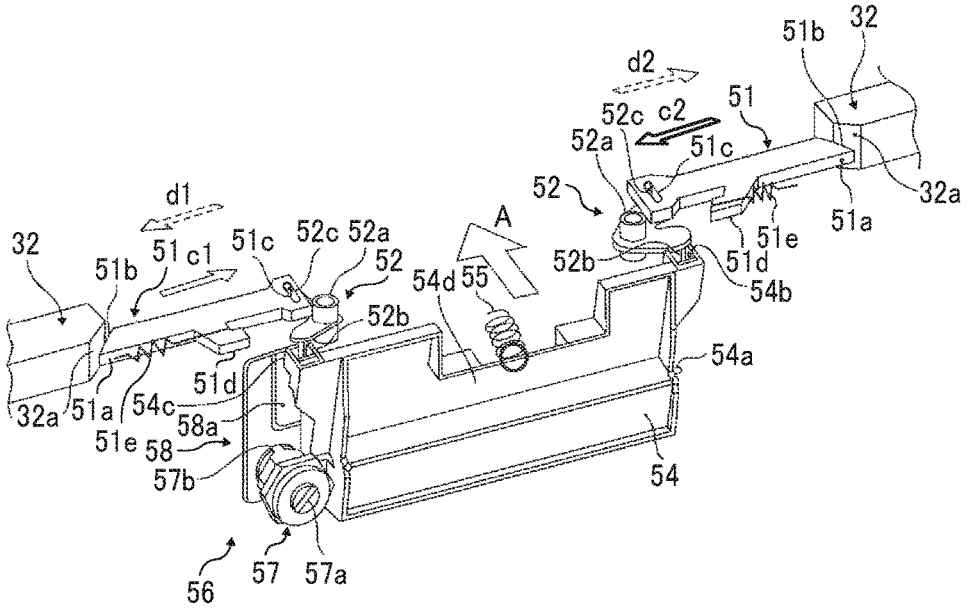
FIGS. 6A and 6B are illustrations of the feeding tray when the feeding tray is mounted in a state in which the feeding tray is locked.
Figure 6B:
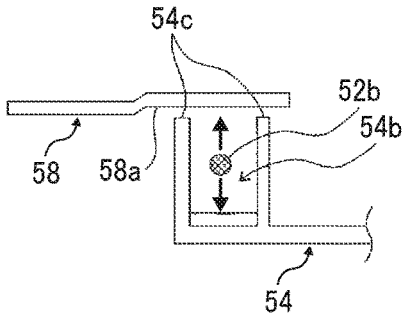

Next, mounting (installing) of the feeding tray 21 in the locked state is described with reference to FIGS. 6A and 6B. FIGS. 6A and 6B are illustrations of mounting of the feeding tray 21 in the locked state. FIG. 6A is an illustration of the feeding tray 21 when the feeding tray 21 is mounted in the locked state. FIG. 6B is an illustration of a positional relationship of the hook 58 of the lock assembly 56, the left link engagement recess 54*b* of the handle 54, and the handle engagement projection 52*b* of the left link member 52 and operation of the handle engagement projection 52*b* in the locked state. Here, in FIG. 6A, the front-cover housing 48 and the feeding-tray housing 40 of FIG. 3 are not illustrated similarly with FIGS. 4 and 5.

As illustrate in FIG. 6A, the stopper portion 32 of the sheet-feeding-device body 30 and the lock member 51 of the feeding tray 21 are tapered. For example, each of the left and right stopper portions 32 includes a stopper tapered portion 32*a*, and each of the left and right lock members 51 includes a lock-member tapered portion 51*b*. By providing the tapered shape as described above, in the unlocked state, when the feeding tray 21 is slid and pushed in a direction indicated by arrow A in FIG. 6A to mount the feeding tray 21 to the mount position of the sheet-feeding-device body 30, the stopper tapered portion 32*a* and the lock-member tapered portion 51*b* slide against each other, thus allowing each lock member 51 to move toward the center (in the direction indicated by arrow c1 or c2). As described above, since each lock member 51 can be moved toward the center, the feeding tray 21 can be mounted to the mount position of the sheet-feeding-device body 30 in the state in which the feeding tray 21 is unlocked.

When the feeding tray 21 is in the locked state, the positional relationship of the hook 58 of the lock assembly 56, the left link engagement recess 54*b* of the handle 54, and the handle engagement projection 52*b* of the left link member 52 are in a state illustrated in FIG. 6B. The handle engagement projection 52*b* of the left link member 52 is disposed so that, even when the handle contact portion 58*a* of the hook 58 rotates in the locked state where the handle contact portion 58*a* contacts the hook contact portion 54*c* of the handle 54, the handle engagement projections 52*b* does not contact the handle contact portion 58*a*. Further, as illustrated in FIG. 6A, the lock member 51 is also disposed so as not to contact the handle contact portion 58*a* of the hook 58 even when a sliding movement operation is performed. That is, even when the feeding tray 21 is locked, the lock member 51 and the link member 52 are in positions where the lock member 51 and the link member 52 do not contact the hook 58.

Accordingly, even when the feeding tray 21 is in the locked state, the left lock member 51 and the handle engagement projection 52*b* of the left link member 52, which rotates with movement of the lock member 51, can move and rotate without contacting the hook 58 and the handle 54. Since the feeding tray 21 can be rotated and moved as described above, the feeding tray 21 can be mounted to the mount position of the sheet-feeding-device body 30 even when the feeding tray 21 is in the locked state. That is, the left lock member 51 and the left link member 52 are in positions where the left lock member 51 and the left link member 52 are not in contact with the hook 58, thus allowing the feeding tray 21 to be mounted to the mount position of the sheet-feeding-device body 30. Here, when the feeding tray 21 is mounted to the mount position, the left and right lock members 51, which have passed through so as to move over the stopper portions 32, are pulled by the tensile force of the tension spring 51*e* to move in directions indicated by arrows d1 and d2 to spread outward from the center side in FIG. 6A. As each lock member 51 moves as described above, the stopped portion 51*a* moves to the stop position and is caught on a rear portion of the stopper portion 32, and the position of the feeding tray 21 with respect to the sheet-feeding-device body 30 is stopped (locked).

With the above-described configuration, at least the following effects can be obtained. That is, with the above-described configuration, the sheet feeding device 20 can mount the feeding tray 21 without damaging the feeding tray 21 including the lock member 51 and the lock assembly 56 or taking time to mount the feeding tray 21 even when the lock assembly 56 is locked. Here, for the sheet feeding device 20 of the image forming apparatus 500 according to the present embodiment, the feeding tray 21 is drawn from the sheet-feeding-device body 30 to the right side in FIG. 1, at which the sheet conveyance path 60 to vertically convey the sheet S is disposed as described above, in other words, toward the vertical conveyance path. However, the sheet feeding device according to the present embodiment is not limited to such a configuration, and is applicable to, for example, a sheet feeding device having a configuration in that the feeding tray is drawn out to the front side in FIG. 1. Such a configuration can also achieve a similar effect to, even if not the same as, the above-described effect.

However, for example, the following effects can be obtained by employing the above-described configuration in which the sheet S is vertically conveyed along the sheet conveyance path 60 from each feeding tray 21 to the paired registration rollers 18. The sheet S conveyed from each sheet feeding device 20 is fed by the paired vertical conveying rollers 24 on each feeding tray 21 and reaches the paired registration rollers 18 via vertical conveyance rollers. When the sheet S is conveyed from the feeding tray 21 of a lower one, such as the sheet feeding device 20*b* or the sheet feeding device 20*c*, of the sheet feeding devices 20*a*, 20*b*, and 20*c* in FIG. 1, the sheet S is conveyed via the paired vertical conveying rollers 24 of the feeding tray 21 of an upper one(s), such as the sheet feeding device 20*a* or the sheet feeding device 20*b*.

Here, the driving roller of the paired conveyance rollers in each sheet feeding device may be disposed on the device body side and the driven roller of the paired conveyance rollers may be disposed on the feeding tray side. In such a configuration, when the driving roller of the paired vertical conveyance rollers is driven, a force is applied in a direction in which the driving roller and the driven roller are separated from each other. Accordingly, if the engagement of the stopper portion to the stopper portion for locking and restricting the movement of the mounted feeding tray is shallow, the mounted feeding tray may be detached. By contrast, the sheet feeding device 20 according to the present embodiment has the configuration in which the stopped portion 51*a* does not move from the stop position to the release position unless the handle 54 of the feeding tray 21 is rotated. Such a configuration can prevent the feeding tray 21 from accidentally detaching from the sheet-feeding-device body 30.

Alternatively, an image forming apparatus may include a sheet feeding device (sheet feeding unit) that includes the following feeding tray (sheet feeding tray) detachably mounted to a device body. The feeding tray includes, for example, a biasing member (a spring), and a lock member (a cam rotatable with rotation of a cylinder portion). The biasing member constantly urges a stopped portion (a leading end of a hook) toward a stopper portion (an upward recessed portion) provided in the device body of the sheet feeding device. The lock member secures the position of the stopped portion to the stop position. Then, by locking the lock member, even if an operator (user) draws the feeding tray, the stopped portion does not move from the stop position to the release position (the hook does not move downward) and the feeding tray cannot be drawn from the device body. By unlocking the lock assembly, the stopped portion can move from the stop position to the release position (the hook moves downward) when the operator draws the feeding tray, thus allowing the feeding tray to be drawn from the device body.

However, in such a configuration in which the sheet feeding device includes the biasing member to constantly urge the stopped portion toward the stopper portion provided in the device body and the lock assembly to secure the position of the stopped portion to the stop position, for example, the following failure may occur. Since the position itself of the stopped portion is secured to the stop position by the lock assembly, even if the feeding tray is mounted in a locked state, the stopped portion hits the stopper portion and the feeding tray cannot be mounted to the device body. Accordingly, if the operator tries to mount the feeding tray vigorously, the feeding tray including the stopper and the lock assembly may be damaged. Alternatively, to properly mount the feeding tray, the lock assembly is unlocked and the feeding tray is mounted. Then, the lock assembly is locked again. As a result, it may take time to mount the feeding tray.

As described above, the sheet feeding device 20 according to the present embodiment includes the feeding tray 21 with the following components. The feeding tray 21 includes the lock member 51. The lock member 51 includes the stopped portion 51*a* to be stopped by the stopper portion 32 of the sheet-feeding-device body 30. The lock member 51 is movable between the stop position, at which the stopped portion 51*a* is stopped by the stopper portion 32, and the release position, at which the lock of the stopped portion 51*a* with the stopper portion 32 is released. The feeding tray 21 further includes the lock assembly 56 to prevent drawing of the feeding tray 21 from the sheet-feeding-device body 30. The sheet feeding device 20 includes the handle 54. A user can rotate the handle 54 by a predetermined angle from the initial state to move the stopped portion 51*a* from the stop position to the release position. The lock assembly 56 restricts the rotation of the handle 54 when the lock assembly 56 is locked. The stopped portion 51*a* of the lock member 51 is movable from the stop position to the release position in conjunction with the operation of mounting the feeding tray 21, which is drawn from the sheet-feeding-device body 30, to the mount position of the sheet-feeding-device body 30 even without rotating the handle 54.

With the above-described configuration of the sheet feeding device 20, for example, the following effects can be obtained. By restricting the rotation of the handle 54 with the lock assembly 56, the lock of the feeding tray 21 at the mount position of the sheet-feeding-device body 30 is not released by the operation of the handle 54. Further, as a configuration of preventing damage of the stopped portion 51*a* and the stopper portion 32 contacting each other when the feeding tray 21 is mounted, for example, a configuration might be considered in which at least one of the stopped portion 51*a* and the stopper portion 32 has a tapered shape inclined relative to a direction in which the feeding tray 21 is installed to the sheet-feeding-device body 30. With such a configuration, when the feeding tray 21 is further pushed and mounted to the sheet-feeding-device body 30 after the stopped portions 51*a* contact the stopper portions 32, each of the stopped portions 51*a* can move from the stop position to the release position along the tapered shaped and move over the stopper portion 32.

In the sheet feeding device 20, the stopped portion 51*a* can move from the stop position to the release position even without rotating the handle 54. Accordingly, even the handle 54 cannot rotate due to the locking of the lock assembly 56, the stopped portion 51*a* can move from the stop position to the release position. Accordingly, even with the lock assembly 56 locked, after the feeding tray 21 is pushed into the sheet-feeding-device body 30 and the stopped portions 51*a* contacts the stopper portions 32, the stopped portion 51*a* can move over the stopper portion 32 and the feeding tray 21 can be mounted to the sheet-feeding-device body 30. Further, after the stopped portion 51*a* contacts the stopper portion 32, the stopped portion 51*a* moves to release the load applied to the stopper portion 32 and the feeding tray 21 including the stopper portion 32. Such a configuration can prevent damage to the feeding tray 21 including the lock members 51 and the lock assembly 56. Accordingly, the sheet feeding device 20 can be provided in which the feeding tray 21 can be mounted without damaging the feeding tray 21 including the lock member 51 and the lock assembly 56 or taking time to mount the feeding tray 21 even when the lock assembly 56 is locked.

When an operating member operated by the user is held in a feeding tray, a load, such as frictional resistance, is applied between a portion of the operating member to be held and a portion of the feeding tray to hold the operating member. As a result, smooth operability may be impaired due to a reduction in component accuracy or degradation over time. For example, in the configuration in which the operating member is slidable relative to the portion of the feeding tray holding the operating member, it may be difficult to reduce an area in which the operating member and the holding portion slide due to the necessity of suppressing, e.g., rattling of the operating member. As a result, smooth operability might be impaired. By contrast, since the handle 54, which is the operating member according to the present embodiment, rotates, the configuration can be employed in which the two rotary projections 54*a* are disposed on the left and right sides of the handle 54 and the front-cover housing 48 of the feeding tray 21 includes bearings to receive the rotary projections 54*a* and fitting portions having a relatively low sliding resistance. Thus, according to the present embodiment, the sheet feeding device 20 can be provided that can more easily suppress the deterioration of the smooth operability of the handle 54 due to a reduction in component accuracy and degradation over time, than other configurations, such as the configuration in which the operating member is slidably disposed.

The sheet feeding device 20 according to the present embodiment includes the link members 52 to convert the rotational motion of the handle 54 into a moving motion in which the stopped portion 51*a* moves between the stop position and the release position. With the above-described configuration of the sheet feeding device 20, for example, the following effects can be obtained. The sheet feeding device 20 according to the present embodiment can use the link members 52 to convert the rotational motion of the handle 54 into the moving motion in which the stopped portion 51*a* moves between the stop position and the release position. Even if the rotation amount and the lateral width of the handle 54 are not increased, such a configuration facilitates the stopped portion 51*a* of the lock member 51 to move between the stop position and the release position.

In the sheet feeding device 20 according to the present embodiment, the lock assembly 56 includes the hook 58 mounted to the rotatable cylinder 57*b* of the cylinder lock 57. When the cylinder lock 57 is locked, at least the handle contact portion 58*a* of the hook 58 is put in the rotation space of the handle 54, thus restricting the rotation of the handle 54. With the above-described configuration of the sheet feeding device 20, for example, the following effects can be obtained. The hook contact portion 54*c* of the rotatable handle 54 contacts the hook 58 that has rotated with the rotation of the cylinder lock 57, thus restricting the rotation of the handle 54. Such a configuration can simplify the shape of the hook 58 and the shape of the hook contact portion 54*c* of the handle 54 to contact the hook 58.

The sheet feeding device 20 according to the present embodiment includes the link members 52 to convert the rotational motion of the handle 54 into the moving motion in which the stopped portion 51*a* of each lock member 51 moves between the stop position and the release position. Even if the lock member 51 and the link member 52 operate in a state in which the cylinder lock 57 is locked, the lock member 51 and the link member 52 do not contact the hook 58. With the above-described configuration of the sheet feeding device 20, for example, the following effects can be obtained. Even if the lock member 51 and the link member 52 operate in the state in which the cylinder lock 57 is locked, the lock member 51 and the link member 52 do not contact the hook 58. Accordingly, the lock members 51, the link members 52, and the hook 58 are not damaged even when the feeding tray 21 is mounted to the sheet-feeding-device body 30 in the state in which the cylinder lock 57 is locked. The sheet feeding device 20 according to the present embodiment is configured such that at least a portion of the stopped portion 51*a* and the stopper portion 32 to contact each other before the mounting of the feeding tray 21, which is drawn from the sheet-feeding-device body 30, to the mount position of the sheet-feeding-device body 30 is completed, is tapered as in the stopper tapered portion 32*a* or the lock-member tapered portion 51*b*.

With the above-described configuration of the sheet feeding device 20, for example, the following effects can be obtained. With the above-described configuration, when the feeding tray 21 is further pushed and mounted to the sheet-feeding-device body 30 after the stopped portions 51*a* contact the stopper portions 32, each of the stopped portions 51*a* can move from the stop position to the release position along the tapered shape of the stopper tapered portion 32*a* or the lock-member tapered portion 51*b* and move over the stopper portion 32. By moving over the stopper portion 32, the stopped portion 51*a* can move after the stopped portion 51*a* contacts the stopper portion 32. Accordingly, the load applied to the stopper portion 32 and the stopper portion 32 is released, thus preventing damage to the stopped portion 51*a* and the stopper portion 32. Accordingly, the feeding tray 21 can be mounted to the sheet-feeding-device body 30 without unlocking the lock assembly 56.

Further, the sheet feeding device 20 according to the present embodiment includes the tension spring 51*e* to urge the stopped portion 51*a* of the lock member 51 toward the position at which the stopped portion 51*a* is stopped by the stopper portion 32. With such a configuration of the sheet feeding device 20, when the feeding tray 21 is mounted, the stopped portion 51*a* is automatically stopped by the stopper portion 32, thus locking and restricting the movement of the mounted feeding tray 21.

The sheet feeding device 20 according to the present embodiment further includes the compression spring 55 to urge the handle 54, which has rotated, so as to return to the initial state. With the above-described configuration of the sheet feeding device 20, for example, the following effects can be obtained. In the state in which the lock assembly 56 is unlocked, a user rotates the handle 54 by a predetermined angle from the initial state, to move the stopped portion 51*a* from the stop position to the release position, thus drawing the feeding tray 21. Then, the handle 54 can be automatically returned to the initial state simply by removing the hand from the handle 54.

In the sheet feeding device 20 according to the present embodiment, the paired vertical conveying rollers 24 to vertically convey the sheet S to be fed are disposed on the downstream side of the feeding tray 21 in the drawing direction. The conveyance driving roller 24*a* of the paired vertical conveying rollers 24 is disposed on the sheet-feeding-device body 30 and the conveyance driven roller 24*b* is disposed on the feeding tray 21.

With the above-described configuration of the sheet feeding device 20, for example, the following effects can be obtained. The driving roller of the paired conveyance rollers in the sheet feeding device may be disposed on the device body side and the driven roller of the paired conveyance rollers may be disposed on the feeding tray side. In such a configuration, when the driving roller of the paired vertical conveyance rollers is driven, a force is applied in a direction in which the driving roller and the driven roller are separated from each other. Accordingly, if the engagement of the stopper portion to the stopper portion for locking and restricting the movement of the mounted feeding tray is shallow, the mounted feeding tray may be detached. By contrast, the sheet feeding device 20 according to the present embodiment has the configuration in which the stopped portion 51*a* does not move from the stop position to the release position unless the handle 54 of the feeding tray 21 is rotated. Such a configuration can prevent the feeding tray 21 from accidentally detaching from the sheet-feeding-device body 30.

The feeding tray according to the present embodiment is the feeding tray 21 that is mounted to any one of the above-described sheet feeding devices 20. With such a configuration, the feeding tray 21 can be provided that having effects equivalent to the effects of any of the above-described sheet feeding devices 20.

The image forming apparatus 500 according to the present embodiment is a printer that includes a sheet feeding device to feed the sheet S or that uses a feeding tray detachably mounted to the sheet feeding device. The image forming apparatus 500 includes any of the above-described sheet feeding devices 20 as the sheet feeding device and uses the above-described feeding tray 21 as the feeding tray. Such a configuration can provide an image forming apparatus capable of achieving the same effect as any of the above-described sheet feeding devices 20 or the above-described feeding tray 21.

Although the present embodiment has been described with reference to the drawings, the concrete configuration is not limited to the above-described configuration including the sheet feeding device 20 according to the present embodiment, and may be changed and modified in design within a range not departed from the scope of this disclosure. For example, the configuration of an apparatus including the sheet feeding device 20 is not limited to the color image forming apparatus, such as the image forming apparatus 500, and may be a monochrome image forming apparatus. Further, the image forming apparatus is not limited to a printer but may be any other type of image forming apparatus, such as a facsimile machine, a copying machine, or a multifunctional peripheral, or an apparatus, such as a sheet folding apparatus, that performs processing on a sheet.

The above-described embodiment is one example and, for example, the following aspects A to M of the present disclosure can provide the following advantages.

Aspect A

A sheet feeding device, such as the sheet feeding device 20, includes a device body, such as the sheet-feeding-device body 30, including a stopper portion, such as the stopper portion 32 and a feeding tray, such as the feeding tray 21, detachably mounted to the device body. The feeding tray includes a stopper, a lock assembly, and an operating member. The stopper, such as the lock member 51, includes a stopped portion, such as the stopped portion 51*a*, to be stopped by the stopper portion. The stopper is movable between a stop position at which the stopped portion is stopped by the stopper portion and a release position at which the stopped portion is released from the stopper portion. The lock assembly, such as the lock assembly 56, prevents drawing of the feeding tray from the device body 30. The operating member, such as the handle 54, rotates from an initial state by a predetermined angle to move the stopped portion from the stop position to the release position. The lock assembly restricts rotation of the operating member when the lock assembly is locked. The stopped portion of the stopper is movable from the stop position to the release position with an operation of mounting the feeding tray, which is drawn from the device body, to a mount position of the device body without rotation of the operating member.

According to this, as described in the present embodiment, for example, the following effects can be obtained. Restricting the rotation of the operating member with the lock assembly prevents the stopping of the feeding tray with respect to the mount position of the device body from being released by the operation of the operating member. As a configuration of preventing damage of the stopped portion and the stopper portion contacting each other when the feeding tray is mounted, for example, a configuration can be employed in which at least one of the stopped portion and the stopper portion has a tapered shape inclined relative to a direction in which the feeding tray is installed to the device body. With such a configuration, when the feeding tray is further pushed and mounted to the device body after the stopped portion contacts the stopper portion, the stopped portion can move from the stop position to the release position along the tapered shape and move over the stopper portion.

In the present aspect (aspect A), the stopped portion can move from the stop position to the release position without rotation of the operating member. Accordingly, even the operating member cannot rotate due to the locking of the lock assembly, the stopped portion can move from the stop position to the release position. Thus, even when the lock assembly is locked, after the feeding tray is pushed into the device body and the stopped portion contacts the stopper portion, the stopped portion moves so as to get over the stopper portion and the feeding tray can be mounted to the device body. After the stopped portion contacts the stopper portion, the stopped portion moves to release the load applied to the stopper and the feeding tray including the stopper. Such a configuration can prevent the feeding tray including the stopper and the lock assembly from being damaged. Such a configuration can provide the sheet feeding device in which the feeding tray can be mounted without damaging the feeding tray including the stopper and the lock assembly or taking time to mount the feeding tray even when the lock assembly is locked.

Aspect B

In aspect A, the sheet feeding device further includes a link member, such as the link member 52, disposed between the operating member and the stopper to convert rotation of the operating member to a movement of the stopped portion between the stop position and the release position. According to aspect B, as described in the present embodiment, for example, the following effects can be obtained. That is, using the link member, the rotational motion of the operating member can be converted into the moving motion in which the stopped portion moves between the stop position and the release position. Accordingly, even if the amount of rotation and the lateral width of the operating member are not increased, the stopper portion of the stopper can be easily moved between the stop position and the release position.

Aspect C

In aspect A or B, the lock assembly includes a cylinder lock, such as the cylinder lock 57, having a rotary cylinder portion, such as the cylinder 57*b*, and a hook, such as the hook 58, mounted on the rotary cylinder portion. When the cylinder lock is locked, at least a portion, such as the handle contact portion 58*a*, of the hook is put in a rotation space of the operating member to restrict rotation of the operating member. According to aspect C, as described in the present embodiment, for example, the following effects can be obtained. A portion, such as the hook contact portion 54*c*, of the operating member rotated contacts at least a portion of the hook rotated with the rotation of the cylinder lock, thus restricting the rotation of the operating member. Such a configuration can simplify the shape of the contact portion of the operating member contacting the hook and the shape of the hook.

Aspect D

In aspect C, the sheet feeding device further includes a link member, such as the link member 52, disposed between the operating member and the stopper to convert rotation of the operating member to a movement of the stopped portion between the stop position and the release position. The stopper and the link member are disposed to not contact the hook when the stopper and the link member operate in a state in which the cylinder lock is locked. According to aspect D, as described in the present embodiment, for example, the following effects can be obtained. Even if the stopper and the link member operate in the state in which the cylinder lock is locked, the stopper and the link member do not contact the hook. Accordingly, even if the feeding tray is mounted to the device body in the state in which the cylinder lock is locked, the stopper, the link member, and the hook are not damaged.

Aspect E

In any of aspects A to D, the stopped portion and the stopper portion contact each other before mounting of the feeding tray, which is drawn from the device body, to the mount position of the device body is completed. At least one of the stopped portion and the stopper portion has a tapered shape, such as a tapered shape of the lock-member tapered portion 51*b* or the stopper tapered portion 32*a*.

According to aspect E, as described in the present embodiment, for example, the following effects can be obtained. With such a configuration, when the feeding tray is further pushed and mounted to the device body after the stopped portion contacts the stopper portion, the stopped portion can move from the stop position to the release position along the tapered shape and move over the stopper portion. By moving over the stopper portion, the stopped portion can move after the stopped portion contacts the stopper portion. Accordingly, the load applied to the stopper portion and the stopper portion is released, thus preventing damage to the stopped portion and the stopper portion. Accordingly, the feeding tray can be mounted to the device body without unlocking the lock assembly.

Aspect F

In any one of aspects A to E, the sheet feeding device further includes a biasing member, such as the tension spring 51*e*, to urge the stopped portion toward the stop position at which the stopped portion is stopped by the stopper portion. According to aspect F, as described in the present embodiment, when the feeding tray is mounted, the stopped portion is automatically stopped by the stopper portion, thus locking and restricting the movement of the mounted feeding tray.

Aspect G

In any one of aspects A to F, the sheet feeding device includes a biasing member, such as the compression spring 55, to urge the operating member in a direction in which the operating member returns to the initial state. According to aspect G, as described in the present embodiment, for example, the following effects can be obtained. In the state in which the lock assembly is unlocked, an operator rotates the operating member from the initial state by a predetermined angle to move the stopped portion from the stop position to the release position. After the drawing operation of the feeding tray is performed, the operating member can be automatically returned to the initial state only by releasing an operator's hand from the operating member.

Aspect H

In any one of aspects A to G, the sheet feeding device further includes paired vertical conveying rollers, such as the paired vertical conveying rollers 24, disposed downstream from the feeding tray in a drawing direction of the feeding tray, to vertically convey a sheet. A driving roller, such as the conveyance driving roller 24*a*, of the paired vertical conveying rollers is disposed on the device body and a driven roller, such as the conveyance driven roller 24*b*, of the paired vertical conveying rollers is disposed on the feeding tray.

According to aspect G, as described in the present embodiment, for example, the following effects can be obtained. The driving roller of the paired conveyance rollers in the sheet feeding device may be disposed on the device body side and the driven roller of the paired conveyance rollers may be disposed on the feeding tray side. In such a configuration, when the driving roller of the paired vertical conveyance rollers is driven, a force is applied in a direction in which the driving roller and the driven roller are separated from each other. Accordingly, if the engagement of the stopper portion to the stopper portion for locking and restricting the movement of the mounted feeding tray is shallow, the mounted feeding tray may be detached. By contrast, in any one of aspects A to G, unless the operating member of the feeding tray is rotated, the stopped portion does not move from the stop position to the release position. Such a configuration can restrict detachment of the feeding tray from the device body.

Aspect I

In a feeding tray detachably mounted to a sheet feeding device to feed a sheet, such as the sheet S, the feeding tray is the feeding tray, such as the feeding tray 21, mounted to the sheet feeding device, such as the sheet feeding device 20, according to any one of aspects A to H. According to aspect I, as described in the present embodiment, a feeding tray can be provided that can exert the same effect as the effect of the sheet feeding device according to any one of Aspects A to H.

Aspect J

In an image forming apparatus, such as the image forming apparatus 500, that includes a sheet feeding device to feed a sheet, such as the sheet S, or that uses a feeding tray detachably mounted to a sheet feeding device, the image forming apparatus includes the sheet feeding device, such as the sheet feeding device 20, according to any one of aspects A to H, or uses the feeding tray, such as the feeding tray 21, according to any one of aspect I. According to aspect J, as described in the present embodiment, an image forming apparatus can be provided that can achieve the same effect as the effect of the sheet feeding device of any one of aspects A to H or the feeding tray according to aspect I.

The above-described embodiments are illustrative and are not intended to limit the present disclosure. Thus, numerous additional modifications and variations are possible in light of the above teachings. For example, elements and/or features of different illustrative embodiments may be combined with each other and/or substituted for each other within the scope of the present invention.

What is claimed is:

1. A sheet feeding device comprising:

a device body including a stopper portion; and a feeding tray detachably mounted to the device body, the feeding tray including:

a stopper including a stopped portion to be stopped by the stopper portion, the stopper movable between a stop position at which the stopped portion is stopped by the stopper portion and a release position at which the stopped portion is released from the stopper portion;

a lock assembly to prevent drawing of the feeding tray from the device body; and a handle to rotate from an initial state by a predetermined angle to move the stopped portion from the stop position to the release position, the lock assembly to restrict rotation of the handle when the lock assembly is locked, the stopped portion of the stopper movable from the stop position to the release position with an operation of mounting the feeding tray, which is drawn from the device body, to a mount position of the device body without rotation of the handle.

2. The sheet feeding device according to claim 1, further comprising:

a link member disposed between the handle and the stopper to convert rotation of the handle to a movement of the stopped portion between the stop position and the release position.

3. The sheet feeding device according to claim 1, wherein the lock assembly includes:

a cylinder lock having a rotary cylinder portion; and a hook mounted on the rotary cylinder portion, wherein, when the cylinder lock is locked, at least a portion of the hook is put in a rotation space of the handle to restrict rotation of the handle.

4. The sheet feeding device according to claim 3, further comprising:

a link member disposed between the handle and the stopper to convert the rotation of the handle to a movement of the stopped portion between the stop position and the release position, wherein the stopper and the link member are disposed to not contact the hook when the stopper and the link member operate in a state in which the cylinder lock is locked.

5. The sheet feeding device according to claim 1, wherein the stopped portion and the stopper portion contact each other before mounting of the feeding tray, which is drawn from the device body, to the mount position of the device body is completed, and wherein at least one of the stopped portion and the stopper portion is tapered.

6. The sheet feeding device according to claim 1, further comprising:

a biasing member to urge the stopped portion toward the stop position at which the stopped portion is stopped by the stopper portion.

7. The sheet feeding device according to claim 1, further comprising:

a biasing member to urge the handle in a direction in which the handle returns to the initial state.

8. The sheet feeding device according to claim 1, further comprising:

paired vertical conveying rollers disposed downstream from the feeding tray in a drawing direction of the feeding tray, to vertically convey a sheet, wherein a driving roller of the paired vertical conveying rollers is disposed on the device body and a driven roller of the paired vertical conveying rollers is disposed on the feeding tray.

9. An image forming apparatus comprising:

an image forming unit to form an image on a sheet; and the sheet feeding device according to claim 1 to feed the sheet to the image forming unit.

10. The image forming apparatus according to claim 9, wherein the sheet feeding device further includes a link member disposed between the handle and the stopper to convert rotation of the handle to a movement of the stopped portion between the stop position and the release position.

11. The image forming apparatus according to claim 9, wherein the lock assembly includes:

a cylinder lock having a rotary cylinder portion; and a hook mounted on the rotary cylinder portion, and wherein, when the cylinder lock is locked, at least a portion of the hook is put in a rotation space of the handle to restrict rotation of the handle.

12. The image forming apparatus according to claim 11, wherein the sheet feeding device further includes a link member disposed between the handle and the stopper to convert the rotation of the handle to a movement of the stopped portion between the stop position and the release position, and wherein the stopper and the link member are disposed to not contact the hook when the stopper and the link member operate in a state in which the cylinder lock is locked.

13. The image forming apparatus according to claim 9, wherein the stopped portion and the stopper portion contact each other before mounting of the feeding tray, which is drawn from the device body, to the mount position of the device body is completed, and wherein at least one of the stopped portion and the stopper portion is tapered.

14. The image forming apparatus according to claim 9, wherein the sheet feeding device further includes a biasing member to urge the stopped portion toward the stop position at which the stopped portion is stopped by the stopper portion.

15. The image forming apparatus according to claim 9, wherein the sheet feeding device further includes a biasing member to urge the handle in a direction in which the handle returns to the initial state.

16. The image forming apparatus according to claim 9, wherein the sheet feeding device further includes paired vertical conveying rollers disposed downstream from the feeding tray in a drawing direction of the feeding tray, to vertically convey a sheet, and wherein a driving roller of the paired vertical conveying rollers is disposed on the device body and a driven roller of the paired vertical conveying rollers is disposed on the feeding tray.

17. A feeding tray detachably mountable to a device body of a sheet feeding device, the feeding tray comprising:

a stopper including a stopped portion to be stopped by a stopper portion of the device body, the stopper movable between a stop position at which the stopped portion is stopped by the stopper portion and a release position at which the stopped portion is released from the stopper portion;

a lock assembly to prevent drawing of the feeding tray from the device body; and a handle to rotate from an initial state by a predetermined angle to move the stopped portion from the stop position to the release position, the lock assembly to restrict rotation of the handle when the lock assembly is locked, the stopped portion of the stopper movable from the stop position to the release position with an operation of mounting the feeding tray, which is drawn from the device body, to a mount position of the device body without rotation of the handle.

18. An image forming apparatus comprising:

an image forming unit to form an image on a sheet; and the feeding tray according to claim 17 to stack the sheet to be fed to the image forming unit.

* * * * *